United States Patent [19]

Zivkovich

[11] Patent Number: 4,710,681

[45] Date of Patent: Dec. 1, 1987

[54] PROCESS FOR BURNING A CARBONACEOUS FUEL USING A HIGH-ENERGY ALTERNATING CURRENT WAVE

[76] Inventor: Aleksandar Zivkovich, 93 Stuyvesant Rd., Pittsford, N.Y. 14534

[21] Appl. No.: 829,972

[22] Filed: Feb. 18, 1986

[51] Int. Cl.[4] ..... F02P 3/04; F02P 15/08

[52] U.S. Cl. ..... 315/209 T; 431/2; 431/255; 431/263; 123/648; 123/628; 123/606; 123/607; 123/608; 123/DIG. 9

[58] Field of Search ..... 431/2, 255, 263; 123/DIG. 9, 648, 628, 606, 607, 608; 315/209 T

[56] References Cited

U.S. PATENT DOCUMENTS

| | | | |
|---|---|---|---|
| 4,359,998 | 11/1982 | Topic | 123/606 |
| 4,382,430 | 5/1983 | Iwasaki | 123/606 |
| 4,445,492 | 5/1984 | Rouanes | 123/606 |
| 4,522,185 | 6/1985 | Nguyen | 123/606 |

OTHER PUBLICATIONS

Ward, "Solid-State CD Ignition", Feb. 1967, *Radio Electronics,* pp. 32–34.

*Primary Examiner*—David K. Moore
*Assistant Examiner*—Michael J. Nickerson
*Attorney, Agent, or Firm*—Bruns and Wall

[57] ABSTRACT

A process for burning a carbonaceous fuel is disclosed. This process involves the steps of providing a combustion chamber equipped with a spark gap, introducing the fuel into the chamber, providing a high-energy a.c. wave, and connecting the wave to one of the electrodes of the spark gap.

The alternating current wave used in the combustion process of this invention has a peak voltage of from 25,000 to 200,000 volts, a frequency of from 8,000 to 80,000 herz, and an energy of at least 600,000,000 volt-herz. The use of this wave creates an arc across the electrodes of the spark gap, thereby facilitating the combustion of the fuel.

8 Claims, 3 Drawing Figures

PROCESS FOR BURNING A CARBONACEOUS FUEL USING A HIGH-ENERGY ALTERNATING CURRENT WAVE

FIELD OF THE INVENTION

A combustion process in which, in a combustion chamber equipped with a spark gap, a high-energy alternating current wave is connected to the electrode of the spark gap to create an arc and burn carbonaceous fuel in the chamber.

The invention is more particularly directed to the use of a high-energy, high-voltage, high-frequency alternating current wave in a combustion process.

SUMMARY OF THE INVENTION

A process for burning a carbonaceous fuel is disclosed which involves the steps of providing a combustion chamber equipped with a spark gap, introducing the carbonaceous fuel into the chamber, providing a high-energy wave, and connecting the wave to one of the electrodes of the spark gap. The high-energy wave is an alternating-current wave with a peak voltage of from about 25,000 to about 200,000 volts, a frequency of from about 8,000 to about 80,000 cycles per second, and an energy of at least about 600,000,000 volt Hertz. The use of this wave creates an arc across the electrodes of the spark gap and facilitates the combustion of the fuel.

BRIEF DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

In the process of this invention, a high-energy wave is used in a combustion process. One of the preferred means for producing this wave is illustrated in the schematic diagram of FIG. 1.

Figure 1:
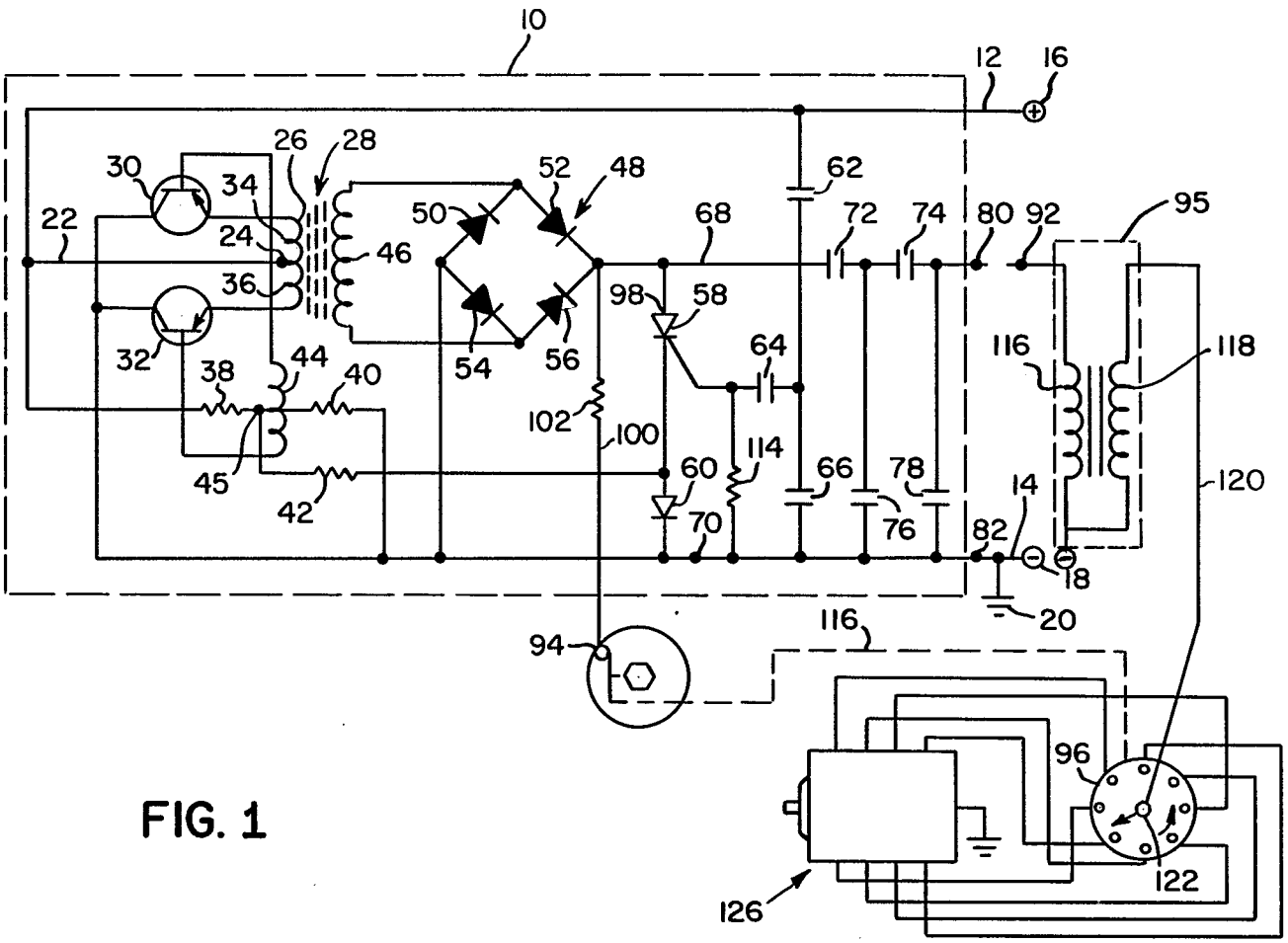
FIG. 1 is a schematic diagram of one circuit which can be used to produce the high-energy alternating-current wave used in the process of this invention.

FIG. 1 illustrates one embodiment of the ignition system of this invention utilized in an internal combustion engine. Although FIG. 1 illustrates the use of the invention with an eight-cylinder internal combustion engine, the invention can be used with other engines. Thus, by way of illustration and not limitation, the invention can be used with four-cylinder internal combustion engines, six-cylinder internal combustion engines, 2-cycle engines, 4-cycle engines, diesel engines, and the like. Thus, the invention can be used with aircraft engines.

As is shown in FIG. 1, a source of direct current (not shown) is applied across lines 12 and 14. Any source of direct current may be used. However, because most engines utilize batteries, it is preferred that the source of direct current be a battery. It is preferred that the battery supply from about 6 to about 48 volts of direct current across lines 12 and 14. It is even more preferred that the battery supply from about 6 to about 24 volts of direct current across lines 12 and 14. In one preferred embodiment, the battery supplies about 12 volts of direct current across lines 12 and 14.

It is preferred that the positive pole 16 of the battery be connected to line 12 and the negative pole of the battery 18 be connected to line 14 and ground 20. However, in some embodiments of this invention, the polarity may be reversed.

In general, the voltage from the battery is applied across lines 12 and 14 when a switch is closed. Thus, in most conventional starter circuits used in automobiles, when the key is turned in the steering column, the voltage from the battery is applied to the ignition system. Reference may be had to pages 1-1 to 1-38 of "Petersen's Big Book of Auto Repairs", Tenth Edition (Petersen Publishing Company, Los Angeles, Calif., 1983), the disclosure of which is hereby incorporated by reference into this specification.

When the switch (not shown) is closed, voltage is supplied through line 12 to line 22 to a transformer junction or center tap 24. Transformer junction or center tap 24 is located in the primary 26 of a step-up transformer 28.

The current supplied to line 22 must be converted to alternating current before it can be increased by step-up transformer 28. One means of converting this direct current to alternating current is illustrated in FIG. 1; other means will be apparent to those skilled in the art. As is shown in FIG. 1, the converter circuit is comprised of switching transistors 30 and 32. These transistors operate as a direct-current to alternating-current inverter. Such d.c. to a.c. inverters are well known to those skilled in the art and are described in, e.g., pages 275–299 of the "Solid State Devices Manual" (RCA Corporation, Somerville, N.J., 1975), the disclosure of wich is hereby incorporated by reference into this specification. In the Examples contained in this specification, switching transistors 30 and 32 were SK 9136 PNP transistors. In place of these transistors, one or more DTG 110 PNP and/or 2N3055 NPN transistors could be used in the circuit of the Examples. If a PNP transistor is used, the collector of the transistor can be directly connected to the ground. If, however, a NPN transistor is used, the collector must be insulated and the polarity must be reversed.

Although applicant does not wish to be bound to any particular theory, he believes that the inverter circuit shown in FIG. 1 works as described below. The direct current flows to transformer junction 24 and through primary winding 26. Primary winding 26 is comprised of upper section 34 and lower section 36, which are joined by transformer junction 24. The battery voltage is applied to the transformer. The flux density in the transformer core varies between the saturation value in one direction and the saturation value in the opposite direction. At the start of the conduction period for one transistor, the flux density in the core is at either its maximum negative value (−B saturation, the saturation of the base of the transistor) or its maximum positive value (+B saturation). For example, transistor 30 switches on at −B saturation. During conduction of transistor 30, the flux density changes from its initial level of −B saturation and becomes positive, as energy is simultaneously stored in the inductance of the transformer and supplied to the load by the battery. When the flux density reaches +B saturation, transistor 30 is switched off and transistor 32 is switched on. The transformer assures that energy is supplied to the load at a constant rate during the entire period that transistor 30 conducts. This energy transformation cycle is repeated when transistor 32 conducts. Initially, sufficient bias is applied to saturate transistor 30. As a result, a substantially constant voltage waveform is produced in the primary winding. In this push-pull coupled converter, the transition to "switch-off" is initiated when the transformer begins to saturate. As long as the transistor is not saturated, the product of the transformer inductance and the time rate of change of the collector current remains constant. When the transformer core is saturated, however, the inductance decreases rapidly toward zero, with the result that the time rate of change of the collector current increases toward infinity. When the collector current reaches its maximum value, transistor 30 moves out of saturation and the winding voltage decreases and then reverses, thereby causing transistor 30 to switch off. The reversal of the winding voltage switches transistor 32 on, and the switching operation is repeated as long as current is supplied.

As is known to those skilled in the art, the bases of different switching transistors must be biased to different extents for suitable operation. In the circuit shown in FIG. 1, when switching transistors 30 and 32 are SK 9136 PNP transistors, the bases of such transistors should be biased to a value of from about 2.4 to about 2.5 volts. Resistors 38, 40, act as voltage dividers and provide the proper bias to the bases of transistors 30 and 32. When switching transistors 30 and 32 are SK 9136 PNP transistors, resistor 38 is preferably 10 ohms and 2 watts, resistor 40 is preferably 50 ohms and 25 watts, and another resistor 42 preferably 4,700 ohms and 0.25 watts is coupled to the junction of the resistors 38,40.

Feedback winding 44 is connected between the base of transistor 32 and the base of transistor 30. When the current through the upper half 34 of the primary transformer winding 26 reaches a point where it no longer can increase because of resistance in the primary circuit and/or transformer core saturation, the signal applied to the transistor 32 from the feedback winding 44 drops to zero, turning transistor 32 off. The current in this feedback winding 44 immediately starts decreasing, causing a collapse of the magnetic field. This collapsing field, cutting across all the winding in the transformer, develops voltages in the transformer opposite in polarity to the voltage developed by the expanding field. This voltage now drives transistor 32 into cutoff and transistor 30 into conduction, and it simultaneously delivers power to the diode bridge shown in FIG. 1. Once started, this action converts the applied battery voltage into an alternating current.

The alternating current produced by the converter circuit using transistors 30 and 32 is a square wave a.c.; and the alternating current produced in the secondary 46 of transformer 28 is also a square-wave a.c., albeit one with a different voltage. The square-wave a.c. from the transformer is transformed into pulsating d.c. by the full-wave rectifier of FIG. 1.

One may use a light-activated silicon controlled rectifier ("LASCR") as a triggering device in place of points. If it is desired to use such a device, it should be connected at about the midpoint 45 of feedback winding 44.

As is known to those skilled in the art, other means of converting the direct current from the battery into alternating current and of increasing the voltage of the alternating current can be used. Thus, by means of illustration and not limitation, other two-transistor, one-transformer push-pull switching converters can be used. One such converter is illustrated in FIG. 316 (at page 282) of the aforementioned "Solid-State Devices Manual."

Transformer 28 is a step-up transformer, i.e., it increases the voltage of the wave impressed across primary winding 26. It is preferred that the voltage which is developed across secondary winding 46 of transformer 28 be from about 100 to about 400 volts. It is more preferred that the voltage which is developed across the secondary winding 46 be from about 200 to about 400 volts.

The output from secondary winding 46 is fed into a full-wave rectifier in order to produce a fully rectified direct-current with a voltage of from about 200 to about 400 volts. Any of the full-wave rectifiers known to those skilled in the art can be used. FIG. 1 illustrates one such full-wave rectifier 48, which is comprised of diodes 50, 52, 54, and 56. The output from full-wave rectifier 48 is pulsating d.c. with a voltage of from about 200 to about 400 volts.

The output from full-wave rectifier 48 is converted into a high-frequency alternating current (a.c.) wave with a frequency of from about 8,000 to 50,000 cycles per second. Any means known to those skilled the art for converting a full-wave-rectified d.c. wave with a voltage of from about 200 to about 400 volts into a high-frequency a.c. wave with a voltage of from about 200 to about 400 volts may be used.

One suitable conversion means is illustrated in FIG. 1. This conversion means is comprised of resistor 42 (which supplies a positive voltage signal to control the silicon controlled rectifier), silicon controlled rectifier 58 (to chop the high-voltage d.c.), diode 60 (which is used to insure the supply of some positive voltage to the silicon controlled rectifier), and capacitors 62, 64, and 66 (which are used to transfer a positive signal to the gate of the silicon controlled rectifier). In the circuit described in the Examples of this case, capacitor 62 has a capacitance of 0.01 microfarads, capacitor 64 has a capacitance of 0.22 microfarads, and capacitor 66 has a capacitance of 0.1 microfarads.

The silicon controlled rectifier, also known as an "SCR", is a triode reverse-blocking thyristor. Silicon controlled rectifiers are described on pages 745–747 of the "McGraw-Hill Encyclopedia of Electronics and Computers, Fifth Edition (McGraw-Hill, Inc., New York, 1982), the disclosure of which is hereby incorporated by reference into this specification.

A suitable silicon controlled rectifier will be chosen so that, with the amount of direct voltage being applied to it, it will produce an alternating current with a frequency of from about 8,000 to about 50,000 cycles per second, as measured between points 68 and 70. It is preferred that the alternating current produced have a frequency of from about 12,000 to about 45,000 cycles per second. It is more preferred that the alternating current have a frequency of from about 20,000 to about 40,000 cycles per second. In an even more preferred embodiment, the alternating current has a frequency of from about 25,000 to about 35,000 cycles per second.

The alternating current produced by the SCR circuit will have a voltage of from about 200 to about 400 volts.

Those skilled in the art, given the input to silicon controlled rectifier 58 and the desired output, will be able to choose any of several SCR's which will be suitable. By way of illustration, applicant has used SCR's such as nos. 276-1067, 267-1000, and 267-1020.

Those skilled in the art will be able to choose suitable diodes to use as diodes 50, 52, 54, 56, and 60. Different diodes may be used, or the same diode may be used. In the experiment described in the Examples, diode IN 4004 was used for each of diodes 50, 52, 54, 56, and 60.

The silicon controlled rectifier 58 in the circuit of FIG. 1 produces an AC output wave across points 80 and 82, and this wave has substantially the same frequency as the output from the secondary winding 46. To accomplish this, two inputs are provided from the inverter or converter circuit 30, 32, 34, 36, 38 to the silicon controlled rectifier 58. A first input flows from the center tap 24 of primary winding 26, through line 22 and through capacitors 62 and 64 to the gate of the silicon controlled rectifier 58, and serves to turn the SCR 58 on. A second input flows to the cathode of the SCR 58 from the center top 45 of the feedback winding 44, and through the resistor 42. The second input is out of phase with the first input, and serves to shut the SCR 58 off after a brief period of conductance. Both the first and second inputs have the same frequency as the wave that appears on the secondary winding 46.

One of the advantages of the circuit described in FIG. 1 is that it achieves the desired waveform with only one oscillator for converting the direct current. This arrangement is obviously more economical than circuits which require two or more oscillators for the same purpose. This unique arrangement allows one to ultimately produce a high-energy, high-voltage, high-frequency alternating current wave which is suitable for causing the combustion of such fuels as natural gas, hydrogen, gasoline, kerosene, alcohol, and the like; moreover, the wave can be used in any engine combustion chamber which utilizes a spark plug or a glow plug for combustion. Furthermore, the wave can be used to ignite explosives, rocket engines, and other combustible materials.

The combustion chamber in which the wave is utilized must contain a spark gap, i.e., a region between two electrodes in which a disruptive electrical discharge may take place. Suitable combustion chambers include, e.g., the pistons used in internal combustion engines, the walls of a jet engine, the combustion compartment in a rotary engine, the combustion compartment in a diesel engine, and the like. Any of the combustion chambers known to those skilled in the art which contain a spark gap can be used in the process of this invention.

The output wave from SCR 58 is passed through capacitors 72 and 74 (which are connected in series) and capacitors 76 and 78. The function of these capacitors is to act as a DC blocking filter network to shape the output wave suitably, to stabilize the output wave, to make the wave more regular. Suitable capacitors can be chosen, as is known to those in the art, to perform these functions. In the circuit used in the Examples, capacitors 72 and 74 are rated at 2 microfarads and 600 volts, capacitor 76 is rated at 0.02 microfarads, and capacitor 78 is rated at 0.033 microfarads and 1,000 volts. One may use, e.g., capacitor Z25U for for capacitor 76. It is important that both capacitors 76 and 78 must be rated at a voltage of at least 1,000 volts.

Figure 2:
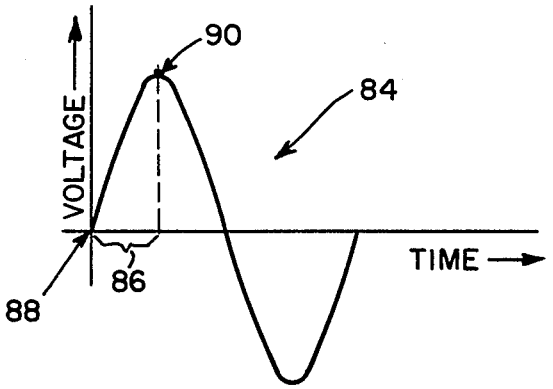
FIG. 2 is a graph of the shape of the output wave obtained across points 80 and 82 of the circuit of FIG. 1.

The output may be measured across points 80 and 82. This output will be a high-frequency alternating current wave with a rise time of from about 3 to about 30 microseconds. Reference may be had to FIG. 2 for an illustration of how the term "rise time" is used in this specification. In FIG. 2, one cycle 84 of the output wave is illustrated. The time it takes, 86, for the wave to go from the zero point 88 to its peak 90 is the "rise time." It is preferred that the rise time of the smoothed wave be from about 4 to about 20 microseconds. It is even more preferred that the rise time be from about 4 to about 10 microseconds.

The connectors for high-frequency module 10 are points 16, 18, 92, and 94. Point 16 connects the positive end of the battery with the high-frequency module 10. Point 18 connects the negative end of the battery with high-frequency module 10. Point 92 is an output line connecting the smoothed oputput from the high-frequency module to the coil. Point 94 connects the high-frequency module to the triggering device 96.

The triggering device 96 may be a conventional distributor comprised of breaker points. Such a conventional triggering device is described in many prior art sources including, e.g., pages 3-1 to 3-61 of "Petersen's Big Book of Auto Repair," Tenth Edition (Petersen Publishing Co., Los Angeles, Calif., 1983), the disclosure of which is hereby incorporated by reference into this specification.

The triggering device 96 may be a light-activated silicon controlled rectifier (LASCR). Thus, e.g., one can use an optical sensor such as, e.g., that described on page 523 of "Understanding Automotive Electronics," (Texas Instruments, Inc., Dallas, Tex., 1982), the disclosure of which is hereby incorporated by reference into this specification.

The output from full-wave rectifier 48 is connected to the anode 98 of silicon controlled rectifier 58; and it is also connected to triggering device 96 through line 100. Intermediate full wave rectifier 48 and triggering device 96 is resistor 102. This resistor 102 serves a very important function in high-frequency module 10: it insures that the output across points 80 and 82 is continuous even when the points in the triggering device 96 are closed.

Figure 3:
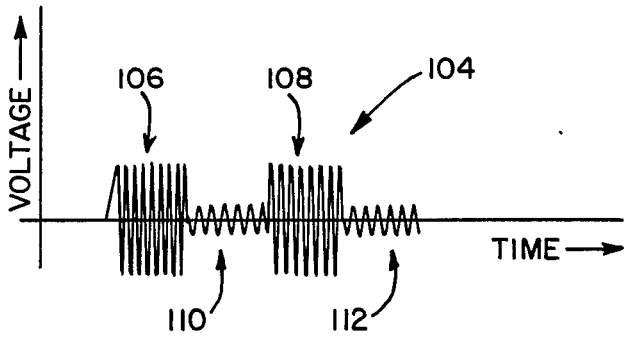
FIG. 3 is a graph of the continuous-oscillation wave obtained across points 80 and 82 of the circuit of FIG. 1.

The use of resistor 102 insures that the output across points 80 and 82 will be a continuous-oscillation, varying voltage, alternating current wave. This type of wave is illustrated in FIG. 3. In this Figure, wave 104 has its maximum amplitude at times 106 and 108 when the points of the triggering device 96 are open, and it has its minimum amplitude at times 110 and 112 when the points of the triggering device 96 are closed. However, in this waveform, at all times (with the exception of when the waveform crosses the x axis), the waveform has some finite voltage; thus, it is said to be continuous.

It is preferred that the maximum voltage of the waveform, which occurs at times 106 and 108, be from about 200 to about 400 volts. Up to about 600 volts can be used, but it is preferred to use no more than about 400 volts.

It is preferred that the minimum voltage of the waveform, which occurs at times 110 and 112, be at least about 2 volts and, more preferably, at least about 8 volts. It is even more preferred that it be at least about 12 volts.

In one embodiment, the maximum voltage of the waveform is 400 volts and the minimum voltage of the waveform is about 15 volts.

Resistor 102 is chosen so that it will have a resistance sufficient to cause a voltage drop to the required minimum voltage. In the circuit described in the Examples, resistor 102 has a resistance of 125 ohms and is rated at 25 watts.

Resistor 114 insures that the gate of silicon controlled rectifier 58 is positive and has a charge of up to about 2 volts. In the circuit described in the Examples, resistor 114 has a resistance of 1000 ohms.

The output from the high-energy module 10 is connected to coil 95 by connectors 92 and 94. Connector 94 feeds output from high-energy module 10 through triggering device 96. Any of the ignition coils well known to those skilled in the art can be used in this invention. Thus, by way of illustration, the ignition coil described in U.S. Pat. No. 3,824,977 (which has a secondary/primary turns ratio of 60/1) can be used; the disclosure of this patent is hereby incorporated by reference into this specification. Thus, e.g., the high-frequency module 10 of this invention can be used with any of the ignition coils described in the following publications: (1) A. R. Rogowski, "Elements of Internal-Combustion Engines" (McGraw-Hill, New York, 1953); (2) "Engine Service Guide" (Chrysler Corportion, Detroit, Mich., 1978); (3) T. Baumeister (ed.), "Standard Handbook for Mechanical Engineers", 7th ed. (1967); (4) J. Carroll and D. Fink, "Standard Handbook for Electrical Engineers", 10th ed. (1968); (5) M. Tepper, "Transistor Ignition Systems Handbook" (1965); and (6) B. Ward, Jr., "Transistor Ignition Systems Handbook" (1963). The disclosure of each of these publications is hereby incorporated by reference into this specification.

Coil 95 is a step-up transformer with more turns in its secondary 118 than in its primary 116. The output from coil 95 is fed through line 120 to triggering device 96. When triggering device 96 is a conventional distributor comprised of breaker points, line 120 is connected to the center 122 of the distributor. The triggering device—distributor distributes the high-frequency, high-voltage waveform to the sparkplugs of engine 126.

When the points of triggering device 96 are open, the output from secondary 120 will be a high-voltage, high-frequency wave. In general, when the points of the triggering device are open, the output wave will have a voltage of from about 25,000 to about 200,000 volts (peak voltage) and a frequency of from about 8,000 to 50,000 cycles per second; the output will be an alternating current wave. In a preferred embodiment, the output wave will have a frequency of from about 12,000 to about 45,000 cycles per second and a voltage of from about 25,000 to about 100,000 volts (peak voltage). In a more preferred embodiment, the output wave have a frequency of from about 20,000 to about 40,000 cycles per second. In the most preferred embodiment, the output wave have a frequency of from about 25,000 to about 35,000 cycles per second. In the experiment described by the Examples, the output wave was an alternating-current wave with a voltage of about 80,000 volts and a frequency of about 30,000 cycles per second.

When the points of triggering device 96 are open, the output wave is fed from secondary 118 through line 120 to triggering device 96 and then to a sparkplug of engine 126. As long as the point are open, a high-energy arc appears across the electrodes of the sparkplug. As used in this specification, the term "arc" refers to a luminous discharge of electric current crossing a gap between two electrodes. One of the unique features of applicant's ignition system is that, unlike conventional spark ignition systems (where the spark only exists for a portion of the time the points of the triggering device are open), the arc created in applicant's ignition system exists for as long as the points of the triggering device 96 are open: the duration of the energy imparted to the sparkplug is much greater with the arc than with the spark.

As indicated above, the output from secondary 118 will be a high-voltage, high-frequency wave; it also will be a high-energy wave. In this specification, the term "volt-Hertz" is used to describe the energy of the output waves. A "volt-Hertz" is an energy unit derived from multiplying the frequency of the wave (in cycles per second, or "Hertz") by the voltage of the wave. Thus, by the way of illustration and not limitation, an alternating current wave with a peak voltage of 80,000 volts and a frequency of 21,000 Hertz has an energy of $1680\times10^6$ volt-Hertz.

As the term "energy" is used in this specification and applied to the energy from the output of secondary 120, it refers to the energy of only that portion of the wave which appears when the points of triggering device 96 are open.

The high-voltage, high-frequency output wave from secondary 120 has an energy of at least about 600,000,000 volt-Hertz. It is preferred that said output wave have an energy of at least about 900,000,000 volt-Hertz. It is more preferred that the output wave have an energy of at least about 1,250,000,000 volt-Hertz. In an even more preferred embodiment, the output wave has an energy of at least about 1,600,000 volt-Hertz. In the most preferred embodiment, the output wave has an energy of at least about 2,000,000,000 volt-Hertz.

Although it is preferred that the output wave from secondary 120 have a frequency of from about 8,000 to about 50,000 Hertz, higher frequencies can be utilized. Thus, e.g., in one experiment performed by the applicant the frequency of the output wave was about 80,000 Hertz and its voltage was about 80,000 volts. In another experiment performed by the applicant, the frequency of the output wave was about 60,000 Hertz and its voltage was about 80,000 volts.

As indicated above, the output across points 80 and 82, which is fed into coil 95, is a continuous-oscillation, varying voltage, alternating current wave which, when the points of triggering device 96 are open, delivers a high-energy wave to the primary of the ignition coil. As the term "energy" is used in this specification and applied to the energy of the wave appearing across points 80 and 82, it refers to energy of only that portion of the wave which appears when the points of triggering device 96 are open; thus, e.g., referring to FIG. 3, the term "high-energy" when applied to this wave refers only to the energy contained in portions 106 and 108 of the wave.

The output across points 80 and 82 has an energy of at least about 3,000,000 volt-Hertz. It is preferred that the output across points 80 and 82 have an energy of at least about 4,500,000 volt-Hertz. It is even more preferred that the output across points 80 and 82 have an energy of at least about 6,300,000 volt-Hertz. In an even more preferred embodiment, the output across points 80 and 82 has an energy of about 8,400,000 volt-Hertz.

The ignition system of this invention, when utilized with an automobile, comprises: a source of electrical energy, which preferably will be a source of direct current voltage (such as a battery); an ignition coil which includes a primary winding and a secondary winding; a plurality of spark plugs, each of which is located in a combustion chamber; and means for sequentially coupling said spark plugs to the secondary winding of the ignition coil (such as a distributor).

Although the invention has been described with reference to use in an internal combustion engine, it can be utilized in any combustion chamber with a spark gap in which carbonaceous fuel is present.

The term carbonaceous, as used in this specification, refers to carbon-containing materials. By way of illustration and not limitation, some suitable carbonaceous fuels include gasoline, kerosene, number 2 fuel oil, natural gas, number 6 fuel oil, aromatic and aliphatic alcohols containing 1–10 carbon atoms, naphtha, mixtures of one or more of the above fuels with one or more of the other such fuels, and mixtures of one or more of the above carbonaceous fuels with air. In one preferred embodiment, the carbonaceous fuel is a mixture of gasoline and air in which the average mixture contains about 16 parts of air to each part of gasoline.

Any suitable combustion chamber can be used in the process. Thus, by way of illustration and not limitation, each cylinder of an internal combustion engine contains a combustion chamber. As is known to those skilled in the art, as the piston starts downward (intake stroke), a charge of atomized fuel from the carburetor is admited into the cylinder because the downward moving piston creates a partial vacuum in the cylinder. An intake valve opened by an eccentric lobe on the camshaft is the device that opens the cylinder to this air-fuel mixture. As the piston reaches the bottom of its stroke and then starts upward, the intake valve closes. With both intake and exhaust valves closed, the piston compresses the mixture (compression stroke). As the piston reaches the very top of its stroke, the spark plug fires and the mixture ignites. The explosive force of the burning mixture pushes the piston downward (power stroke). As the piston nears the bottom of its stroke, the exhaust valve opens by the action of another eccentric lobe on the camshaft. As the piston once again is on an upward stroke (exhaust stroke), the burned gases are expelled out of the cylinder. This process is described in, e.g., the "Mopar Engine Service Guide" (Chrysler Corporation, Detroit, Mich., 1978), the disclosure of which is hereby incorporated by reference into this specification.

In the internal combustion engine; the combustion chamber is the area above the piston with the piston on TDC; the head of the piston, the walls of the cylinder, and the head of the cylinder form the combustion chamber.

In the process of this invention, it is preferred that a spark gap be present in the combustion chamber. As used in this specification, the term spark gap refers to the region between two electrodes in which a disruptive electrical spark may take place; as used herein, the term includes both the electrodes as well as the intervening space. A spark plug furnishes an example of a device comprising a spark gap; its center electrode, air gap, and firing point define a spark gap.

The combustion chamber used in the process of this invention is comprised of means for introducing carbonaceous fuel into the combustion chamber.

In the process of this invention, when the carbonaceous fuel is present in the combustion chamber, the high-voltage, high-frequency, high-energy output wave from secondary 118 is impressed across the electrodes of the spark gap.

The following Examples are presented to illustrate the invention but are not to be deemed limitative thereof. Unless otherwise stated, all parts are by weight and all temperatures are in degrees centigrade.

EXAMPLES

In each of the following Examples, an ignition system comprised of the circuit shown in FIG. 1 was used. The components described in Table 1, presented below, were used. These components are described in either the 1985 edition of the "Semiconductor Reference Guide" (Radio Shack, a Division of Tandy Corporation, Fort Worth, Tex., 1984) and/or the "RCA SK Series Solid State Replacement Guide" (RCA Corporation, Woodbury, N.J., 1984), the disclosure of which guides is hereby incorporated by reference into this specification. In Table 1, a reference to "A" indicates that the component is described in the Semiconductor Reference Guide, and a reference to "B" indicates that the component is described in the "RCA SK Series . . . Guide." The first column in Table 1 refers to the number by which the component is identified in FIG. 1 (e.g., number "30" refers to a switching transistor). The second column in Table 1 discloses the name of the component. The third column in Table 1 discloses where the component is described in either or both of said Guides.

TABLE 1

| Number of component | Name of component | Disclosure in Guides A and B |
|---|---|---|
| 30,32 | Switching transistor SK 9136 | Page 4–10, reference B |
| 50,52,54, 56,60 | Diode IN 40004/276-1103 | Page 136, reference A |
| 58 | Silicon controlled rectifier 276-1067 | Page 10, reference A |

In this circuit, resistor 38 is rated at 10 ohms and 2 watts, resistor 40 is rated at 50 ohms and 25 watts, resistor 42 is rated at 4,700 ohms and and 0.25 watts, resistor 102 is rated at 125 ohms and 25 watts, resistor 114 is rated at 1,000 ohms and 0.25 watts, capacitors 72 and 74 are rated at 2.0 microfarads, capacitor 64 is rated 0.22 microfarads, capacitor 62 is rated at 0.01 microfarads, capacitor 66 is rated at 0.1 microfarads, capacitor 76 is rated 0.02 microfarads (Z5U), and capacitor 78 is rated at 0.033 microfarads.

In accordance with the arrangement disclosed in FIG. 1, this circuit was incorporated into the wiring system of applicant's automobile, a 1977 Pontiac Grand Prix equipped with a 8-cylinder, 301 cubic inch engine.

The catalytic converter on the car was rendered inoperative—all of the material in the converter, including the catalyst, was removed.

EXAMPLE 1

The applicant took 46 trips in the car from Rochester, N.Y. to Syracuse, N.Y. on the New York State Thruway (Interstate 90). A flow meter was attached to the car, and the amount of gas consumed after the car had travelled exactly 50 miles was noted. The car was equipped with a cruise control, and a speed of 55 miles per hour was maintained for each of these trips.

The gas mileage obtained for each of these trips, in miles per gallon, was 37.5, 35.2, 39.3, 38.4, 38.16, 39.06, 42.7 (tailwind), 36.7 (headwind), 39.3, 38.1, 39.6, 39.06, 35.71, 39.39, 37.3, 37.59, 36.49, 36.8, 36.7. 37.8, 38.4, 37, 36.4, 37, 35.7, 36.7, 39.69, 33.5, 34.9, 35.7. 35.7, 38.75, 36.2, 35.7, 34.7, 35.9, 37, 33.7, 35.2, 33.5, 35.4, 40.98

(tailwind), 28.9 (headwind), 37.7, 35.2, and 36.4 miles per gallon.

The E.P.A. mileage estimate for applicant's car, equipped with a functioning catalytic converter, is 23 miles per gallon (see, e.g., a publication entitled "1977 Gas Mileage Guide," Second Edition (U.S. Environmental Protection Agency, January, 1977), at page 15. The E.P.A. mileage data was derived from experiments in which a car was driven at a speed of 50 miles per hour. As is noted on page 8 of the E.P.A. publication, "If your highway driving speed averages faster than the tests average of 50 MPH, you should expect to achieve poorer fuel economy than the highway estimate in this Guide—about 10 to 15 percent less for every 10 MPH above 50 MPH."

The average gas mileage obtained in the experiments of this Example 2 was 36.89 miles per gallon.

EXAMPLE 2

The exhaust emissions of the car equipped with applicant's ignition system were tested by Koerner Ford of Rochester, 2500 West Henrietta Road, Henrietta, N.Y. The testing was conducted with a "Rotunda" exhaust emission tester; during the test the car's engine was run at 2000 revolutions per minute, the engine temperature was 69 degrees Fahrenheit, and the exhaust temperature was 112 degrees Fahrenheit.

The exhaust from the car contained 0.17% of carbon monoxide, 140 parts per million of hydrocarbon, 14.9% of carbon dioxide, and 1.8% of oxygen.

COMPARATIVE EXAMPLE 3

In substantial accordance with procedure of Example 2, the exhaust emissions from applicant's car were tested by Koerner Ford of Rochester. However, the car tested did not contain applicant's high-frequency ignition system (it had been removed from the wiring system), and the car engine was run at 475 revolutions per minute rather than 2,000 revolutions per minute.

The exhaust from the car contained 4.74% of carbon monoxide, 1,291 parts per million of hydrocarbon, 11.4% of carbon dioxide, and 2.0% of oxygen.

The foregoing disclosure and drawings are merely illustrative of the principles of the invention and are not to be interpreted in a limitative sense. The invention is not to be limited to the exact constructions shown and described; for various changes and modifications may be made without departing from the spirit and scope of the invention.

I claim:

1. A process for burning a carbonaceous fuel, comprising the steps of:

(a) providing a combustion chamber containing a spark gap therein, wherein said spark gap is comprised of two electrodes spaced apart from each other;

(b) introducing fuel into said combustion chamber; and (c) providing a continuous alternating current, high-voltage, high-frequency wave to said electrodes, wherein:

said wave is switched between a high voltage during an ignition interval in which said wave has sufficient voltage to arc across said gap and said wave has a peak voltage of from about 25,000 to about 200,000 volts and a lower finite voltage during intervals between successive ignition intervals in which the wave has insufficient voltage to arc across said gap;

said wave has a predetermined frequency of from about 8,000 to about 80,000 cycles per second, and during the intervals between successive ignition intervals said wave maintains said predetermined frequency.

2. In an electronic ignition circuit for applying a high-frequency, high-voltage wave to a spark gap of a spark ignition device in a combustion chamber into which a combustible fuel is introduced and including a.c. means for providing an alternating current high-voltage, high-frequency wave, and switching means coupled to said a.c. means for providing said wave during ignition intervals, and in which said a.c. means includes a d.c.-d.c. converter that is formed of a step-up transformer having a center tap primary, and a secondary, a pair of transistors coupled in push-pull between said primary and a battery potential, with a center tap of the primary being connected to a complementary battery potential, and with said transistors having control electrodes, feedback means coupled to said control electrodes and supplying a feedback signal thereto so that said primary receives oscillations of current through said transistors, and rectifier means coupled to said secondary to produce a high voltage d.c. current, and further including a chopper circuit connected to said rectifier means for producing a high voltage a.c. current; the improvement in which said chopper circuit produces said high voltage a.c. current at a substantially constant predetermined frequency, and includes a trigger circuit coupled to said feedback means and to said pair of push-pull transistors to switch the chopper circuit on and off at said predetermined frequency with oscillations of said transformer primary such that the output wave has a peak voltage of 25,000 to to 200,000 volts and at said predetermined frequency in the range of 8 KHz to 80 KHz; and said switching means is coupled to control the voltage of the chopper circuit so that during said ignition intervals said a.c. wave is provided at the wave peak voltage sufficient to arc across said gap, and during the intervals between successive said ignition intervals said wave is provided at a finite peak voltage insufficient to arc across said gap, but maintaining said substantially constant predetermined frequency during such intervals.

3. The electronic ignition circuit of claim 2, in which the feedback means includes a feedback winding in said stepup transformer, with opposite ends of the feedback winding being connected to said control electrodes of said transistors, and in which said trigger circuit is coupled to said feedback coil to switch the chopper circuit on and off with the oscillations of said transformer primary.

4. The electronic ignition circuit of claim 2, wherein said switching means includes circuit means to reduce the output voltage of said rectifier means during said intervals between ignition intervals, and permit full voltage to be delivered therefrom during said ignition intervals.

5. The electronic ignition circuit of claim 4, in which said combustion chamber has associated therewith timed breaker means for opening and closing a circuit to define said ignition intervals and the intervals between successive spark intervals, and said circuit means includes a resistance bridging the output of said rectifier means to said timed breaker means.

6. The electronic ignition circuit of claim 3, in which said chopper circuit includes an SCR having an anode that is coupled to an output of said rectifier, a cathode, and a gate; and circuit means connected to said feedback winding for applying an alternating voltage across the cathode and gate of said SCR.

7. The electronic ignition circuit of claim 3, in which said chopper circuit is followed by a capacitor network for sharpening said wave, and an ignition coil having a primary receiving the wave from said capacitor network and a secondary connected to said gap electrode.

8. The electronic ignition circuit of claim 3, in which said chopper circuit includes means for removing any d.c. component from said continuous alternating current wave.

* * * * *